United States Patent [19]

Zimmer

[11] 4,331,292

[45] May 25, 1982

[54] INSTANT HOT WATER SUPPLY SYSTEM

[76] Inventor: Eric H. Zimmer, Scenic Dr., R.D. 2, Box 645, Newton, N.J. 07860

[21] Appl. No.: 182,588

[22] Filed: Aug. 29, 1980

[51] Int. Cl.[3] ..... F24D 3/08; F24H 1/22

[52] U.S. Cl. ..... 237/19; 137/337; 236/101 E

[58] Field of Search ..... 237/19; 137/337; 126/362; 236/87, 101 E

[56] References Cited

U.S. PATENT DOCUMENTS 372,232 10/1887 Newman ..... 137/90

2,506,700 5/1950 Chace ..... 236/12

2,677,501 5/1954 Raymond et al. ..... 236/101 E 2,842,155 7/1958 Peters ..... 137/337

3,741,195 6/1973 Ellis ..... 126/362

*Primary Examiner*—Ronald C. Capossela

[57] ABSTRACT

An instant hot water supply system comprising a connection between the hot water and cold water lines incorporating a thermostatic control so that as the water in the hot water line cools off, cold water is allowed to escape and hot water is drawn from the hot water supply to take its place.

11 Claims, 1 Drawing Figure

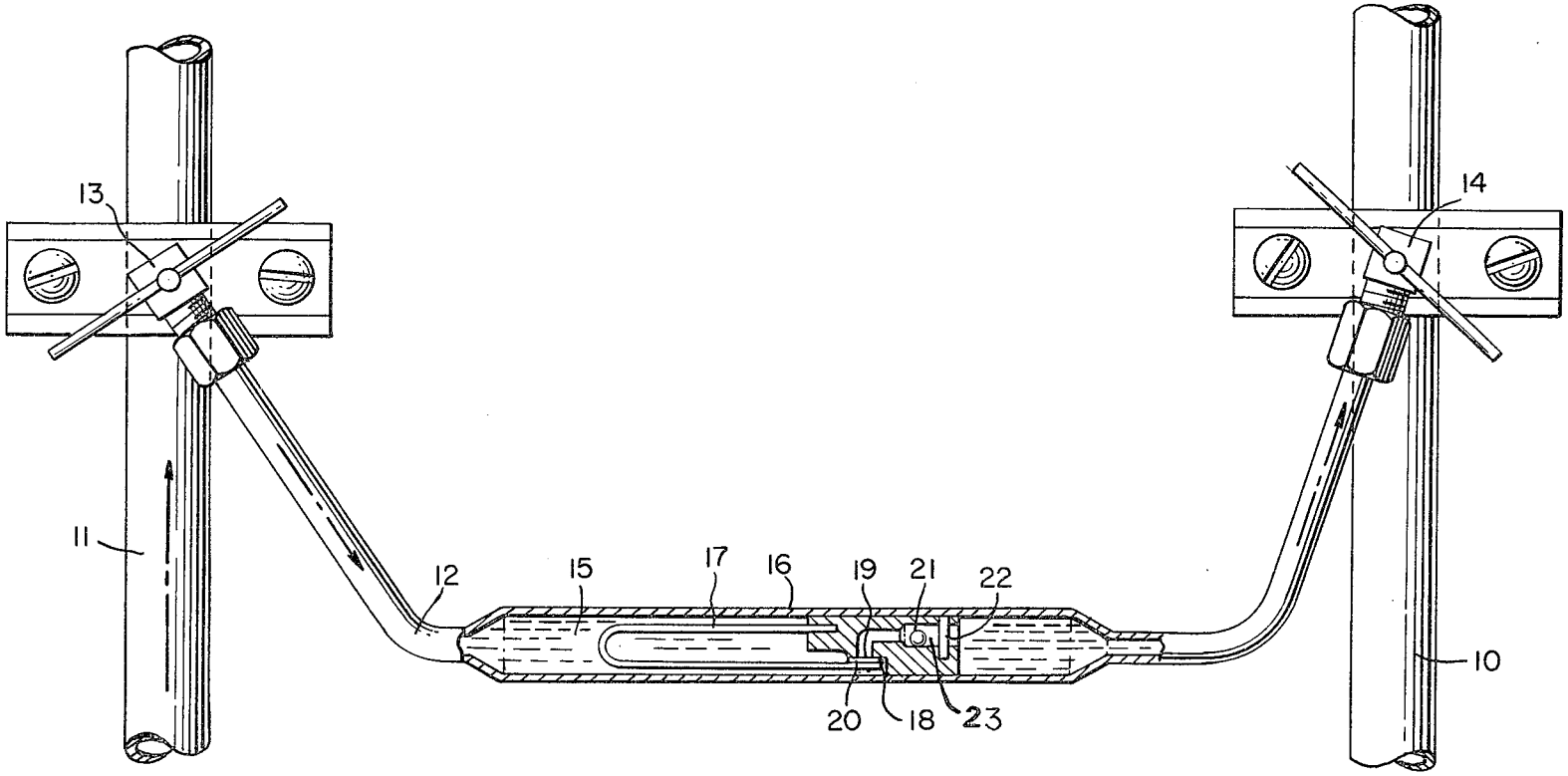
14
10
22
23
21
18
19
20
16
17
15
12
13
11

INSTANT HOT WATER SUPPLY SYSTEM

This invention relates to an instant hot water supply system.

BACKGROUND OF THE INVENTION

In most households, hot water is obtained from taps by opening the hot water valve and letting the water run until the cool water in the line is replaced with hot water from the hot water supply until it is finally discharged from the hot water tap. Depending upon the distance of the hot water tap from the hot water supply, this can take anywhere from a few up to 20–30 seconds and more.

Not only is such a method inconvenient, but it is wasteful of literally billions of gallons of fresh, clean, costly and often scarce drinking water which is allowed to discharge through the drain. Not only is this wasteful of our natural resource of water, but it is wasteful of energy since it requires energy for every gallon of water pumped to and discharged from a tap.

A number of systems have been devised to avoid these problems and provide instant hot water at the tap. Unfortunately, however, these systems have been expensive, relatively complicated, including for example auxilliary water heating components or separate cold water return lines to the hot water supply with electric circulating pumps running twenty-four hours a day. These prior art systems are expensive and usually require installation by skilled tradesmen. Therefore instant hot water systems have not come into widespread, general use.

There accordingly exists a need for a simple, efficient, inexpensive and easy to install instant hot water system which does not suffer from the disadvantages of the prior art.

It is accordingly an object of the invention to provide a unique, instant hot water system which is efficient, yet simple in construction and installation and therefore inexpensive to install.

It is a further object of the invention to provide such a unique instant hot water system which can be installed simply by almost any household member.

Other objects and advantages of the invention will become apparent from the following detailed description of the invention with reference to the accompanying drawings in which:

The FIGURE is a front elevational view of the instant hot water system of the invention, partially in section.

SUMMARY OF THE INVENTION

It has been found that the objects of the invention can be achieved by a hot water system comprising a cold water supply means, a hot water supply means, a liquid connecting means between the cold water supply means and the hot water supply means in the vicinity of an exit for the hot water supply means, which liquid connecting means includes a thermostatic control means for regulating the flow of liquid of varying temperature therethrough, which thermostatic control means comprises a housing adapted to contain one end of a U-shaped bimetallic member which is responsive to thermal force from a liquid and is positioned and adapted so that the free end of the bimetallic member, as a function of said thermal force, is biased towards or away from an orifice in said housing which, when open, allows liquid to pass through said liquid connecting means.

DETAILED DESCRIPTION OF THE INVENTION AND OF THE PREFERRED EMBODIMENTS

With reference to the FIGURE, cold water supply means or pipe 10 is connected to hot water supply means or pipe 11 with liquid connecting means 12 in the vicinity of the tap or exit for hot water supply means 11. The water supply means comprises standard plumbing, such as ¾" diameter from the main water supply and ½" diameter at the tap. Positioning connecting means 12 close to the hot water tap minimizes the cooling of hot water in pipe 11 above the point of entry of connecting means 12 into pipe 11. The connection of connecting means 12 with pipes 10 and 11 is made in any convenient way, but is most simply accomplished by means of simple self-piercing, saddle-tapping valves 13 and 14. These can be installed by anyone who can follow simple directions.

Connecting means 12 includes a thermostatic control means 15 comprising a housing 16 which is adapted to contain one end of a U-shaped bimetallic member 17 which is responsive to a change in temperature of liquid passing in contact with it such that its free end 18 closes or opens an orifice 19 in housing 16. Preferably, the free end of bimetallic member 17 is equipped with a resilient sealing means 20 such as of plastic or rubber which enables it to form a liquid tight seal over orifice 19. Still preferably, resilient sealing means 20 is equipped with feather edged lips to enhance a good seal. Another but less preferred embodiment is provided when the free end of bimetallic member 17 is attached to a floating shutter member which obstructs or seals orifice 19 when the free end of the U-shaped bimetallic member 17 is biased towards said orifice.

In operation, thermostatic control means 15 permits the flow of cold or cool water from hot water pipe 11 to cold water pipe 10 until the water in hot water pipe 11 becomes hot or warm whereupon at some point, depending upon the design and setting of thermostatic control means 15, the flow is terminated. The force or pressure created by the increased or higher pressure of the hot water compared to the cold water in the system will force upper accumulated cold water in hot water pipe 11 through connecting means 12 into cold water pipe 10 and thus circulate indirectly back to the water heater (not shown).

The hot water-cold water exchange rate depends largely on the flow volume of thermostatic control means 15 and on the construction of the bimetallic strip. A satisfactory bimetallic strip which was found to be satisfactory for the purposes of this invention is an alloy of nickel and iron sold by Polymetallurgical Corporation of Attleboro Falls, Mass. as Type 223-1. Other alloys may be readily substituted. It has been found that a satisfactory flow volume is obtained when bimetallic strip or member 17 reacts within about 100°–140° C. to a gap opening of about 0–0.06 inches over an orifice having a diameter between about 0.09–0.15 inches, preferably between about 0.125–0.14 inches. With such an arrangement, the greater the difference in temperature between the hot and cold water, the tighter will be the closure of orifice 19. Anyone skilled in the art may readily determine the optimum gap openings and orifices for other bimetallic strips and various thermostatic control modifications.

Escape of the upper accumulated cool or cold water from hot water pipe 11 into connecting means 12 and indirectly to the water heater, will permit hot water to rise in hot water pipe 11. As the temperature of the water in hot water pipe 11 rises to the desired temperature level, the new thermal force created by the change in temperature, causes bimetallic member 17 to close orifice 19 thereby terminating flow therethrough. This cycle is repeated as hot water is not used and cools off in hot water pipe 11. Thus, instant hot water is continuously supplied and maintained in hot water supply pipe 11.

In a preferred embodiment a ball check 21 is provided in the system, preferably in housing orifice 23 which is adapted to allow hot water to flow to cold water supply means 10 but not to allow cold water to flow to hot water supply means 11. Without ball check 21, the upper portion of hot water pipe 11 will accumulate some cold water due to the tendency of cold water back-up which occurs mainly when any hot water faucet in the system is opened wide resulting in a temporary drop of pressure in hot water pipe 11 and consequently drawing cold water into it.

The ball check, if employed, can be positioned at any suitable place in the system including the interior of connecting means 15 on the outside of bimetallic member 17, but is preferably positioned in housing orifice 23. To accommodate ball check 21 in the position, the orifice may comprise two communicating sections of different diameters with the smaller diameter section located towards the hot water supply means. The ball check may also be retained by any other convenient means such as an O-ring within the housing orifice consisting of a constant diameter tube. Similarly, a retaining pin 22 or some other means is provided to hold the ball check in place when it is pressured towards the cold water side.

It will be seen that with the system according to the invention, an efficient instant hot water system is provided which is simple in construction and installation and is low in cost. A significant advantage of the invention is that the system returns cold water to the system rather than discharge the cold water down the drain as is the case according to present practice when the hot water tap is opened until hot water from the heater emerges from the tap.

It is to be understood that the foregoing description is for illustration purposes only and is not intended to be limiting on the invention which is defined by the following claims:

I claim:

1. An instant hot water supply system comprising:

(a) cold water supply means, (b) hot water supply means, (c) liquid connecting means between the cold water supply means and the hot water supply means in the vicinity of an exit for the hot water supply means, (d) which liquid connecting means includes a thermostatic control means for regulating the flow of liquid of varying temperature therethrough, which thermostatic control means comprises (e) a housing adapted to contain one end of (f) a U-shaped bimetallic member which is responsive to thermal force from a liquid and is positioned and adapted so that the free end of the bimetallic member, as a function of said thermal force, is biased towards or away from (g) an orifice in said housing which, when open, allows liquid to pass through said liquid connecting means.

2. The system according to claim 1 in which the free end of the U-shaped bimetallic member is equipped with resilient sealing means so as to be capable of forming a liquid tight seal over the housing orifice.

3. The system according to claim 2 in which the resilient sealing means is equipped with feather edged lips to enhance a good seal.

4. The system according to claim 2 in which a ball check is provided in the system which is adapted to allow hot liquid to flow to the cold water supply means but not to allow cold water to flow to the hot water supply means.

5. The system according to claim 4 in which the ball check is positioned in the housing orifice.

6. The system according to claim 5 in which the housing orifice comprises two communicating sections of different diameters with the smaller diameter section located towards the hot water supply means.

7. The system according to claim 1 in which a ball check is provided in the system which is adapted to allow hot water to flow to the cold water supply means but not to allow cold water to flow to the hot water supply means.

8. The system according to claim 7 in which the ball check is positioned in the housing orifice.

9. The system according to claim 8 in which the housing orifice comprises two communicating sections of different diameters with the smaller diameter section located towards the hot water supply means.

10. The system according to claim 1 in which self-piercing, saddle-tapping valves are used to connect the cold water supply means and the hot water supply means to the liquid connecting means.

11. The system according to claim 10 in which self-piercing, saddle-tapping valves are used to connect the cold water supply means to the liquid connecting means.

* * * * *